US009247806B2

(12) United States Patent
Lorenzen et al.

(10) Patent No.: US 9,247,806 B2
(45) Date of Patent: Feb. 2, 2016

(54) LIFTING COLUMN PREFERABLY FOR HEIGHT-ADJUSTABLE TABLES

(75) Inventors: Kurt Lorenzen, Broager (DK); Martin Riis, Sydals (DK)

(73) Assignee: Linak A/S, Nordborg (DK)

( * ) Notice: Subject to any disclaimer, the term of this patent is extended or adjusted under 35 U.S.C. 154(b) by 104 days.

(21) Appl. No.: 13/811,822

(22) PCT Filed: Jul. 29, 2011

(86) PCT No.: PCT/DK2011/000088
§ 371 (c)(1),
(2), (4) Date: May 6, 2013

(87) PCT Pub. No.: WO2012/013190
PCT Pub. Date: Feb. 2, 2012

(65) Prior Publication Data

US 2013/0221171 A1 Aug. 29, 2013

(30) Foreign Application Priority Data

Jul. 29, 2010 (DK) ..... 2010 00688

(51) Int. Cl.
*A47B 9/20* (2006.01)

(52) U.S. Cl.
CPC ..... *A47B 9/20* (2013.01)

(58) Field of Classification Search
CPC ..... B66C 23/707; B66C 23/708; A47B 1/10; A47B 9/20
USPC ..... 248/188.5, 161, 188.4; 108/147, 150, 108/147.19
See application file for complete search history.

(56) References Cited

U.S. PATENT DOCUMENTS

| | | | | |
|---|---|---|---|---|
| 2,846,278 | A * | 8/1958 | Blazek | 384/30 |
| 3,887,155 | A * | 6/1975 | Bertalot | 248/333 |
| 4,080,080 | A * | 3/1978 | Cisler | 403/108 |
| 4,190,377 | A * | 2/1980 | Pleuss | 403/108 |
| 6,378,816 | B1 * | 4/2002 | Pfister | 248/161 |
| 6,595,144 | B1 * | 7/2003 | Doyle | 108/147 |
| 7,908,981 | B2 * | 3/2011 | Agee | 108/147 |
| 8,011,308 | B2 * | 9/2011 | Picchio | 108/147 |
| 8,256,359 | B1 * | 9/2012 | Agee | 108/147 |
| 8,752,488 | B2 * | 6/2014 | Moller | 108/20 |
| 2002/0050112 | A1 * | 5/2002 | Koch et al. | 52/651.07 |
| 2005/0002591 | A1 * | 1/2005 | Buitmann | 384/35 |
| 2005/0016806 | A1 | 1/2005 | Klinke | |

FOREIGN PATENT DOCUMENTS

| | | | |
|---|---|---|---|
| DE | 29812762 | | 10/1998 |
| DK | 171903 | | 8/1997 |
| EP | 1004784 | | 5/2000 |
| EP | 1250866 | | 10/2002 |
| EP | 2080447 | A1 * | 7/2009 |
| WO | 9747217 | | 12/1997 |
| WO | 02063996 | | 8/2002 |

* cited by examiner

*Primary Examiner* — Anita M King
(74) *Attorney, Agent, or Firm* — Dykema Gossett PLLC

(57) ABSTRACT

Lifting column, preferably for height adjustable tables, said lifting column comprising at least two relative to each other telescopically arranged members (2*a*, 2*b*, 2*c*). At least one slider (11) is arranged between the two members (2*a*, 2*b*, 2*c*), said slider being secured to one of the members (2*b*). The problem is play between the members (2*a*, 2*b*, 2*c*), resulting in an unstable lifting column. For solution of this problem the member (2*b*) to which the slider (11) is secured, is furnished with a resilient section (17) outlined by a groove (16, 18) against which at least a part of the slider (11) rests. The resilient section (17) can push the slider (11) into firm engagement against the two members (2*b*, 2*c*), at which a stable lifting column which is free from play is achieved.

19 Claims, 7 Drawing Sheets

LIFTING COLUMN PREFERABLY FOR HEIGHT-ADJUSTABLE TABLES

BACKGROUND OF THE INVENTION

1. Field of the Invention

The present invention relates to a lifting column, preferably for height-adjustable tables, the lifting column including at least two relative to each other telescopically arranged members and at least one slider arranged between the two members, the slider being secured to one of the two members. Further, the invention relates to a table furnished with a lifting column of the type described above.

2. The Prior Art

The focus on working environment in recent years has resulted in a wish for free height-adjustment of also common work tables, such as desks. In that connection, lifting columns especially for tables have been developed during the past decade which allows a person to choose freely whether he wishes to sit or stand at the table. This development has caused the price for the height-adjustment to become a determining factor. According to European standard EN 527 the table should be adjustable from a height of 60 cm to 120 cm, but some standards prescribes a higher height, e.g., the Dutch standard NEN 2449, which prescribes an interval from 62 cm to 128 cm. The standing height of the desk makes special demands on the stability of the lifting columns.

The lifting columns are usually made from steel tubes or extruded aluminum tubes cut into desired lengths. Between the individual members the lifting column is furnished with sliders of plastic in the shape of bushings and/or separate bricks, just as sliders in the shape of axially running lists are also known. In some cases ball guides are also used between the members, cf. e.g., WO 97/47217 A1 Herbert Grüttner GmbH & Co KG, which is being practiced by Linak A/S, Denmark, in the lifting column, DL1. On the whole, with regard to the price, only sliders of solid plastic are used.

Generally seen, the tubes are subject to two innate disadvantages—the first being a relatively large dimensional tolerance, which causes relatively large variations in the gap between the members. This further results in that a relatively large play may occur between the members. The play causes the table to appear unstable, which from a user's point of view is unacceptable. A processing of the tubes in order to reduce the dimensional tolerances would result in the lifting columns being unacceptably expensive.

The other disadvantage is that the tubes during the manufacturing process may be twisted about their longitudinal axis. For a tube having, e.g., a square cross section this would result in the cross section, being twisted out off angle, which would cause the gap between the two members to become non-uniform, unless they by chance have the same angle of twist. The gap will not only be non-uniform in its width, but will also vary depending on how much the two members have been twisted relative to each other. It becomes even more troublesome if the two members have been twisted in opposite directions.

To counter the play, adjustable sliders which may be fitted to the present width of the gap have been developed, cf. e.g. EP 1 250 866 A1 Assenburg BV, EP 1 004 784 A1 Magnetic Elektromotoren AG and DE 298 12 762 U1 Phoenix Mecano Komponenten AG, which are all based on sliding wedge-shaped elements in the sliders. Another solution is disclosed in DK-171 903 B1 Linak A/S having adjusting screws for pressing the slider into engagement. In any case the mounting becomes difficult and time-consuming.

WO 02/063996 A1, Rol Egonomic AB discloses a solution for lifting columns having a circular cross section, where sliders in the shape of open rings are placed in countersunk grooves in the members. The solution only takes a situation into account where the slider is larger than the gap between the members. In this situation the slider retracts and adapts to the gap. The solution does not allow for the opposite situation where the gap is wider than the slider. Furthermore, an internal countersinking of grooves in the members is a relatively expensive process.

EP 1 479 963 A2 Heinrich J Kesseböhmer KG discloses a solution with a slider consisting of a hard and a flexible layer, where the flexible layer is intended for compensating for manufacturing and dimensional tolerances. The idea is thus to harden the flexible layer after the mounting. This is a demanding, uncertain and undoubtedly expensive process.

WO 03/047389 A1, Linak A/S discloses another solution where the slider which fits the gap between the members best is chosen from a range of sliders with various thickness where after a local deformation across from the slider is carried out in order to equalize the dimensioning tolerances. Thus, a highly stable lifting column is achieved but the mounting is obvious difficult and expensive, just as the tool for performing the local deformations is rather expensive.

The purpose of the invention is to provide a lifting column as stated in the introductory portion with a simplification of the mounting process of the sliders, which further ensures a stable lifting column.

SUMMARY OF THE INVENTION

This is achieved according to the invention in that the member to which the slider is secured is furnished with a resilient section outlined by a groove against which at least a part of the slider rests. When a slider is chosen having a thickness corresponding to or larger than the width of the gap between the members, the resilient section will press the slider into firm engagement against the two members or in other words, the slider is fixed or preloaded between the two members.

As basis solid sliders are used having a thickness which, when disregarding the dimension tolerances, fits into the gap between two successive members. The resilient section in the member solely alms at compensating for manufacturing and dimensional tolerances, so that the slider will firmly engage the succeeding member, which the slider slides against such that the members appear as being free from play. An optimal state, which is free from play, is achieved by using sliders having a thickness which is slightly larger than the gap between the members, so that the sliders are biased between the members. More specifically, a thickness is used corresponding to the expected maximum width of the gap plus the dimensioning tolerance.

Expediently, the invention is used in connection with members consisting of tube profiles, i.e., having a closed cross section as tube profiles per se provide a great stability. The invention is, however, not limited to that. The members may also be constituted by profiles having an open cross section either of extruded aluminum or bent steel plates.

The resilient properties of the resilient section for one thing depend of the depth of the groove—the deeper the groove the larger the travel of the resilient section. When the groove only partially cuts into the member, it is possible to create a round-going groove so that the resilient section appears brick-shaped. According to an embodiment of the invention, the groove penetrates the wall of the member, which gives good resilient properties and moreover enables an easier processing. This, however, results therein that the groove cannot be round-going, but the resilient section is interconnected with the remaining member in one or more places. This or these connections may be furnished with a groove which does not penetrate the wall of the member.

In an embodiment, the groove is constructed as two groove lengths running in the longitudinal direction of the member and located at a mutual distance from each other.

In another embodiment, the groove is constructed as two groove lengths running across the longitudinal direction of the member at a distance from each other.

These two embodiments are relatively simple in terms of manufacturing. In the first embodiment, the strength of the member is on the whole unchanged as the groove lengths run in the longitudinal direction of the member. In case of a member consisting of a tube profile having a circular cross section, the resilient section will appear almost flat at the groove lengths in the longitudinal direction, which is an advantage.

In a further development the groove lengths in the longitudinal and transverse direction, respectively, of the member are at one end connected to a transverse groove length such that the resilient section appears as a tongue. This results in the resilient properties of the resilient section being particularly good with a relatively long travel.

In a further development of the first embodiment with longitudinal groove lengths, these terminate in the end of the member, corresponding to a slit. This is achievable by means of a simple and uncomplicated processing.

In an embodiment of the invention, a resilient section is only constructed at one end of a member, which during the telescopic movement constantly is in contact with the other member. This area is particularly important for the stability of the lifting column. This applies both in case of a movable member located within a standing member and a movable member located around a standing member.

The invention also relates to a table with one or more of these lifting columns. The lifting columns may appear as table legs for height-adjustment of the table, but the table may also have one or more lifting columns for raising and lowering computer monitors or other equipment relative to the table top.

Depending on whether the slider should work against an internal member or a surrounding member, the deformation is carried out on the outer side or inner side of the member, respectively. It is obvious that a core may be inserted during the deformation to prevent deformation of the internal member or an external backing to prevent deformation of the surrounding member, during a deformation from the inside and outwards.

BRIEF DESCRIPTION OF THE DRAWINGS

The invention will be described more fully below with reference to the accompanying drawing in which.

DETAILED DESCRIPTION OF THE PREFERRED EMBODIMENTS

Figure 1:
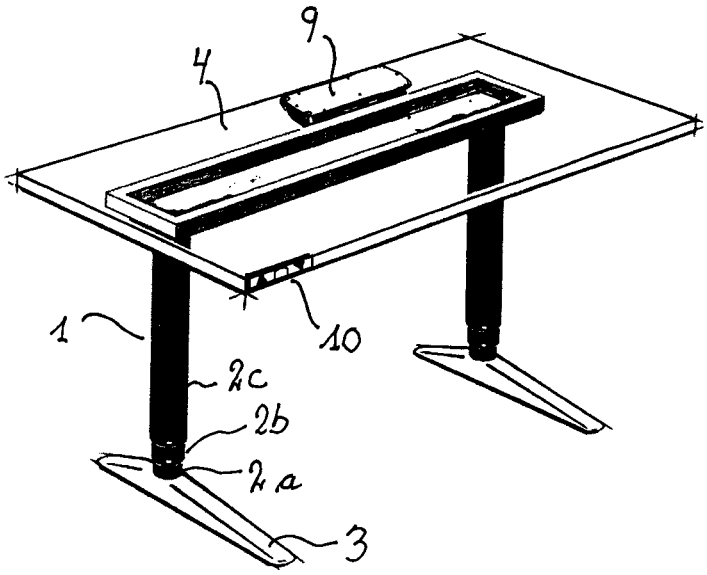
FIG. 1 shows a desk equipped with lifting columns and where the table top is shown transparent.
Figure 3:
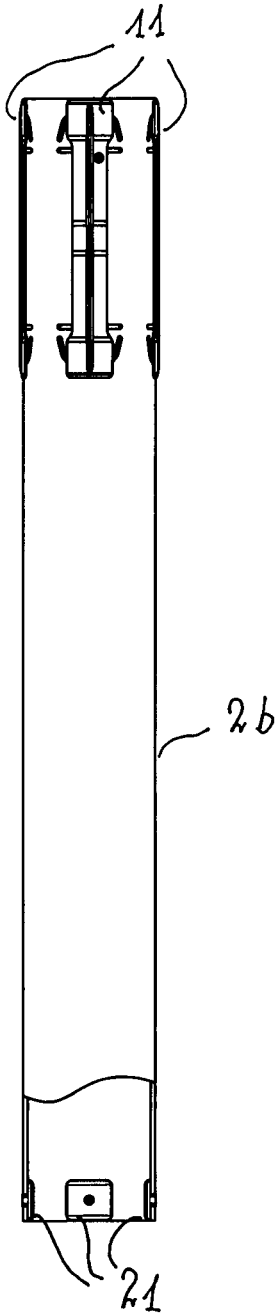
FIG. 3 shows the intermediate member of the lifting columns equipped with sliders seen from the side and where the tube wall at the lower end has been partially removed.
Figure 2:
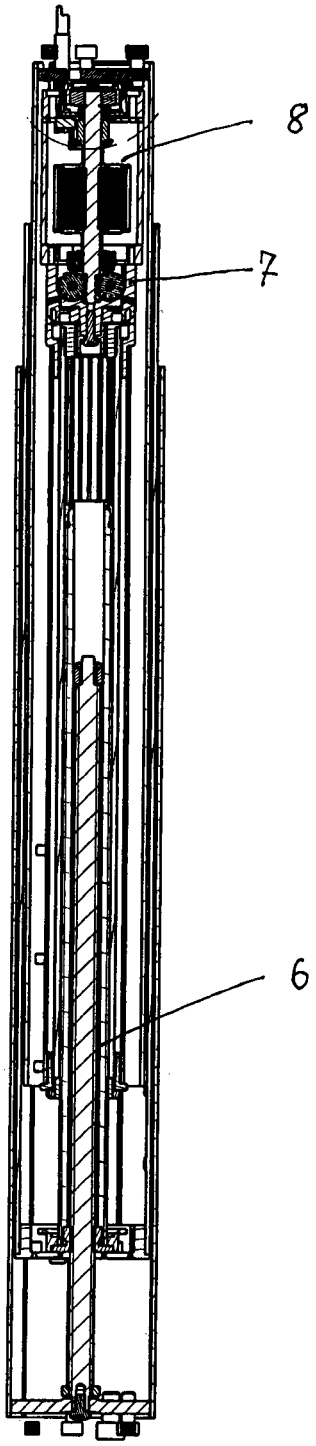
FIG. 2 shows a longitudinal section through a linear actuator located within the lifting columns.
Figure 6:
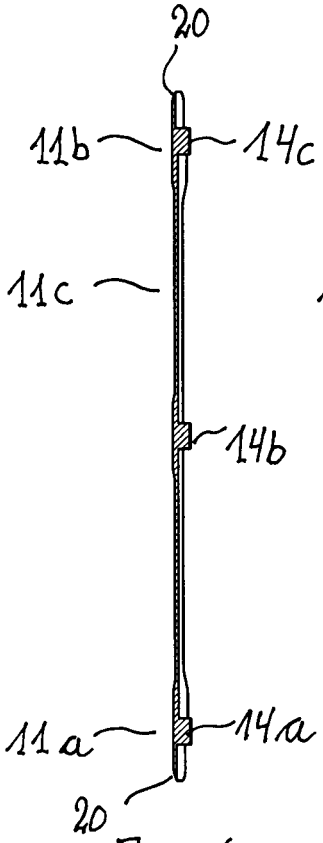
FIG. 6 shows the sliding device seen directly from the side.
Figure 4:
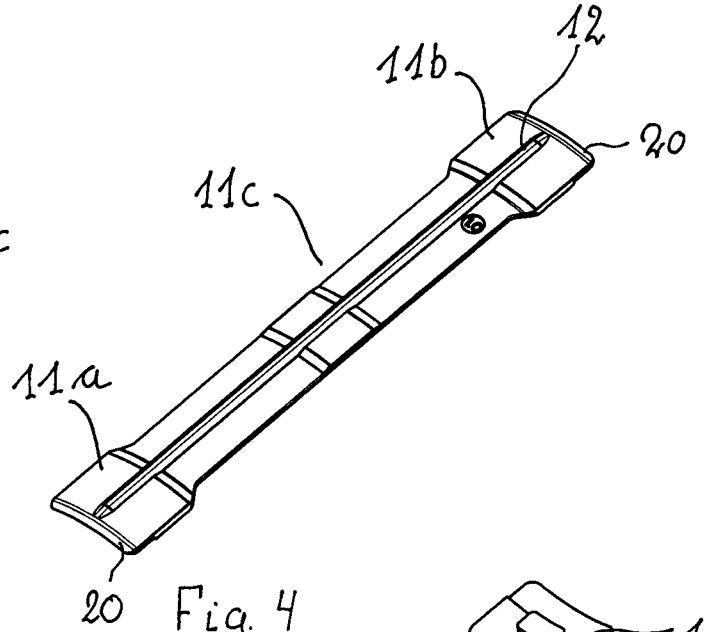
FIG. 4 shows a sliding device seen from the front.
Figure 5:
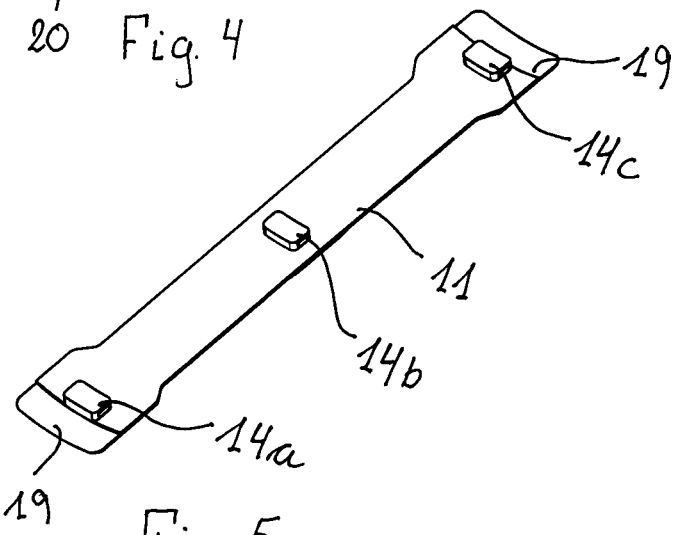
FIG. 5 shows the sliding device in FIG. 4 seen from the rear.

The desk shown in FIG. 1 comprises a lifting column 1 according to the invention at each end. The lifting columns 1 comprises three telescopic members 2*a*, 2*b*, 2*c* and are with the lower end of the innermost member 2*a* fixedly mounted in a foot 3. The table top 4 is mounted on the upper end of the outermost member 2*c* of the lifting columns. The adjustment of the columns are brought about by an incorporated linear actuator 5 comprising a spindle/nut unit 6, which through a gear 7 is driven by an electric motor 8 connected to a control box 9 with a power supply. The control box 9 is likewise equipped with a control device, which is activated by means of an operation panel 10 located at the front edge of the table.

The three members 2*a*,2*b*,2*c* of the lifting column consist of steel profiles having a circular cross section. On the outer side of upper end of the intermediate member 2*b* four sliding devices 11 having a mutual distance of 90° are secured. The sliding devices are furnished with a brick-shaped slider 11*a*, 11*b* which are mutually connected to an elongated connection element 11*c*. The sliding device appears as an elongated element having a curvature at the rear side corresponding to the curvature of the member 2*b*, such that the sliding device can be in firm engagement with the outer side of the member. For mutual securing against rotation of the two members 2*b*,2*c*, i.e., such that they do not pivot about their longitudinal axis relative to each other, the front side of the sliding device 11 has a longitudinal rib 12 intended for protruding into a longitudinal groove 13 on the inner side of the surrounding member 2*b*.

For fastening, the rear side of the sliding device 11 is furnished with three cams 14, one 14*a*, 14*c* at each end and one 14*b* in the middle. The cams 14, having a rectangular cross section, extend into recesses 15 in the member 2*b* intended for that purpose.

Figure 7:
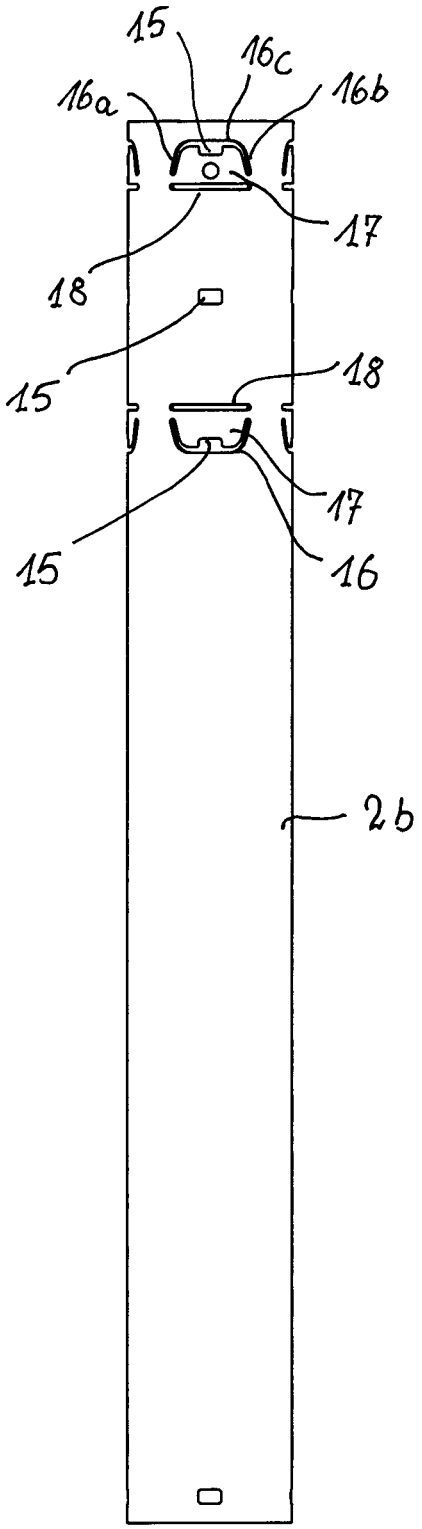
FIG. 7 shows the intermediate member of the lifting column shown without sliding devices.
Figure 9:
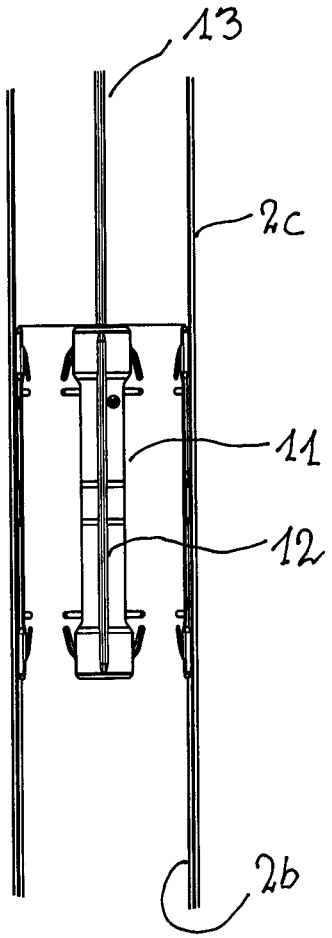
FIG. 9 shows the same as FIG. 8 but where the upper end of the intermediate member is shown in full.
Figure 8:
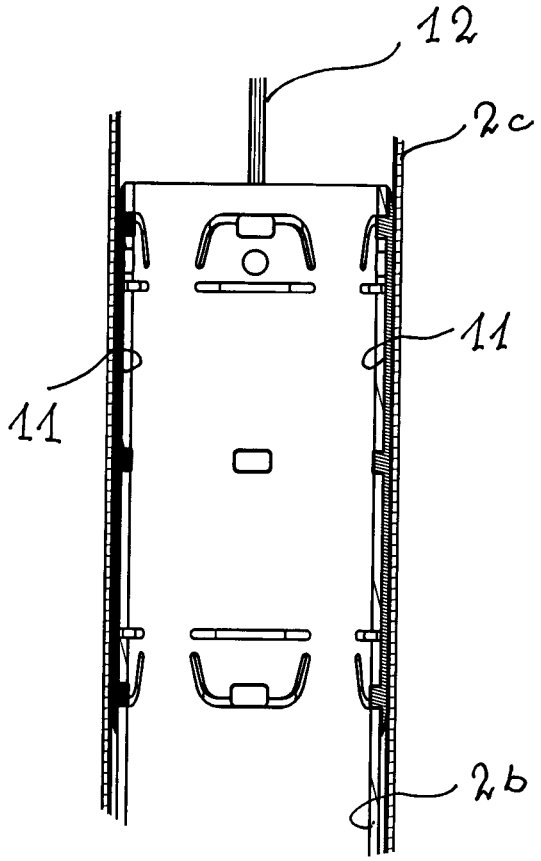
FIG. 8 shows a section through the upper end of the intermediate member and the outermost member.
Figure 10:
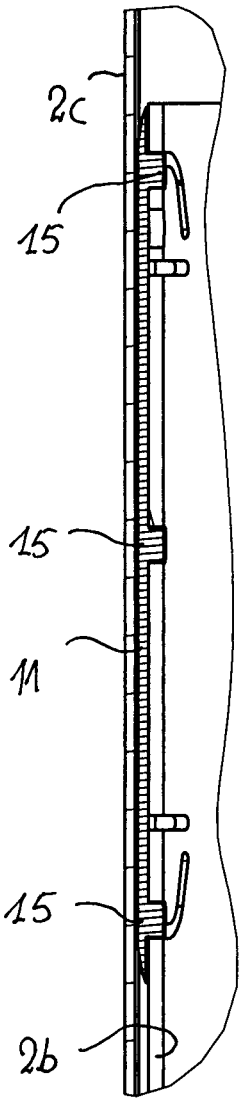
FIG. 10 shows a section through the side wall of the upper end of the intermediate member with the sliding device and the outermost member.
Figure 11:
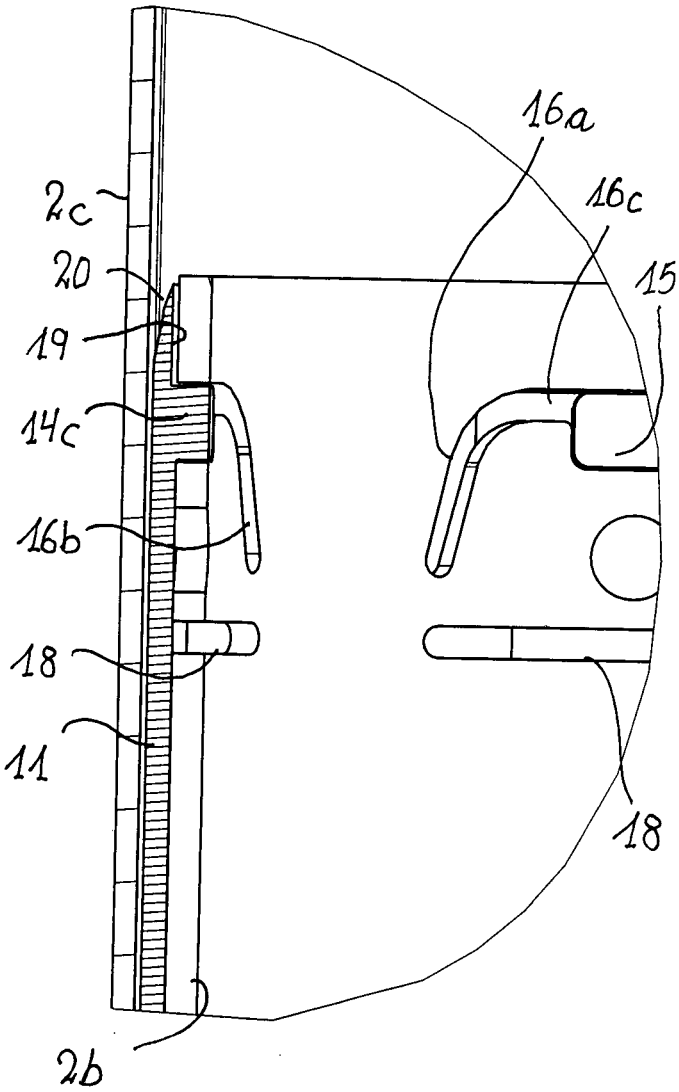
FIG. 11 shows an enlarged view of the upper part of the section shown in FIG. 10.

The area where the brick-shaped sliders 11*a*,11*b* are located is equipped with a resilient section 17 in the member outlined by a groove 16 (see FIG. 7), against which the slider 11*a*,11*b* rests. The groove consists of two longitudinal groove lengths 16*a*,16*b* located at a mutual distance, which at one end is connected to a transverse groove length 16*c*, such that a tongue-shaped resilient section 17 emerges. At a distance from the tongue-shaped resilient section there is a further transverse groove length 18 having a length corresponding to the distance between the two longitudinal groove lengths 16*a*,16*b* such that the resilient section with two connection pieces in the side is connected to the remaining member.

The elongated section 11*c* connecting the two brick-shaped sliders 11*a*,11*b* is thinner than these, which are slightly thicker than the width of the gap between the two members 2*b*,2*c*. The outermost free part of the brick-shaped sliders 11*a*,11*b* has a stepping down 19 at the rear side, such that it is thinner than the remaining slider. The upper side of the brick-shaped sliders 11*a*,11*b* is at the same level. The end of the brick-shaped sliders is further beveled with a slanting surface (20) to the upper side of the sliders.

The brick-shaped sliders 11*a*,11*b* rest with their thick part on the resilient sections 17 and are located entirely within these sections. The thick part of the brick-shaped sliders 11*a*,11*b* thus extends to the transverse groove 18 connecting the two longitudinal grooves 16*a*,16*b*. The outermost free end of the brick-shaped sliders 11*a*,11*b* extends with the stepping down 19 on the rear side freely suspended over the rest of the member on the other side of the transverse groove 18.

When the two members 2*b*,2*c* are assembled, the slanting edge 20 on the end of the brick-shaped sliders 11*a*,11*b* will ease the assembly process and the outer end with the stepping down 19 will be pressed against the outer side of the member 2*b*, where after the thick part of the brick-shaped sliders 11*a*,11*b* will press the resilient section 17 slightly backwards, such that the brick-shaped sliders 11*a*,11*b* at least with its thickest part will be biased between the two members 2*b*,2*c*.

The fixed innermost member 2*a* mounted in the foot 3 which extends into the hollow of the intermediate member 2*b* is at its upper end furnished with corresponding sliding devices, as described above. The intermediate member 2*b* is thus guided with the inner side against these sliding devices. Further, the intermediate member 2*b* is guided by another set of sliders 21 mounted internally at a lower end thereof. These sliders 21, which are designed as bricks, are guided against the outer side of the innermost member 2*a*. The most essential feature for achieving a lifting column which is as free from play as possible is the sliding devices 11 in the area where one member is pulled over the end of the other. The other sliders 21, located lower on the member, may be constructed in a simpler manner, here as bricks, Correspondingly, the lower end of the outermost member 2*c* is fitted with similar sliders 21 guided on the outside of the intermediate member 2*b*.

Figure 14:
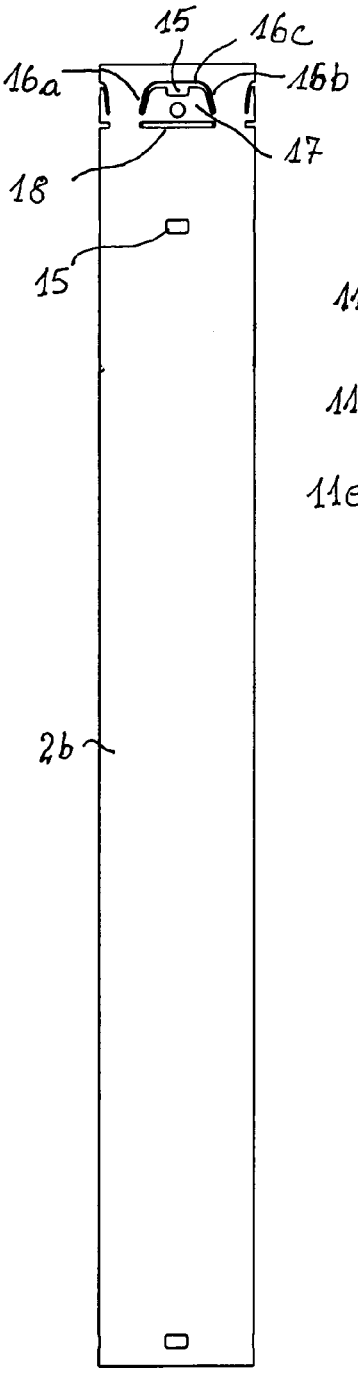
FIG. 14 shows the intermediate member in FIG. 12 shown without sliding devices.
Figure 13:
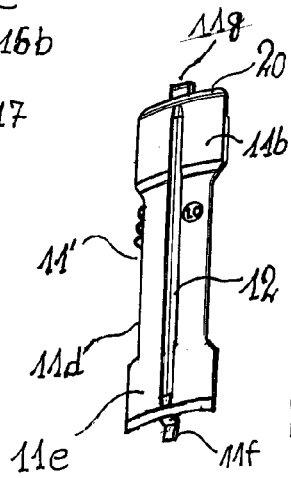
FIG. 13 shows a front view of another embodiment of sliding device.
Figure 12:
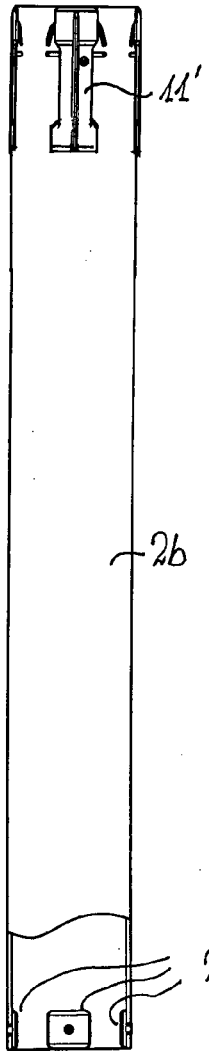
FIG. 12 shows the intermediate member in a slightly different embodiment of the lifting columns equipped with sliders seen from the side and where the tube wall at the lower end has been partially removed.

FIGS. 12-14 of the drawing show another embodiment of the invention than described above. In the drawing the same reference numerals have been used for the same parts as in the embodiment above. In the other embodiment shown, there is only one set of resilient sections 17 and correspondingly the sliding device 11' only has one brick-shaped slider 11*b* likewise having a beveled end 20. On the whole, the elongated section 11*d* corresponds to the elongated section 11*c* in the previous embodiment, it has, however, been closed by means of an end piece 11*e* having the same thickness as the remaining elongated section 11*d*. The lower end of the sliding device 11' has a straight grip head 11*f*, which grips under the wall of the profile 2*b* when a cam on the rear side of the sliding device 11' is guided into a hole in the wall of the profile 2*b*. A small hook 11*g* is provided on the upper end of the sliding device 11', said hook intended for gripping the upper edge of the wall of the profile 2*b* for easing the assembly process of the sliding device 11'.

Figure 15:
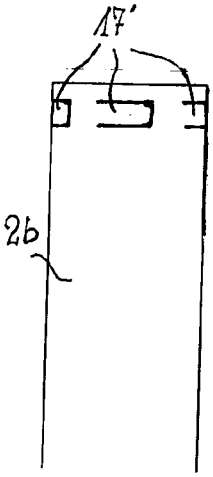
FIG. 15 shows an upper end of the intermediate member of a lifting column, with another embodiment of the resilient section for a sliding device in the lifting column.

In the two previous embodiments, the resilient sections 17 extend in the longitudinal direction of the profile 2*b*. FIG. 15 shows an embodiment where the resilient sections 17' extend across the longitudinal direction of the profile 2*b*. Two sets of resilient sections located at a mutual distance corresponding to the embodiment shown in FIG. 7 may of course also be constructed in this connection. The sliding devices 11,11' shown in FIGS. 4-6 and 13 are also used in this embodiment of the resilient sections 17'.

The invention is here shown in connection with a lifting column having a circular cross section, but the invention may of course also be used for lifting columns having a different cross section, e.g., a square cross section. In a lifting column having a square cross section the invention may be used on the two parallel sides of the lifting column running across the table, thus achieving a lifting column which is free from play in the transverse direction of the table. Play in the longitudinal direction of the table may of course be dealt with in a similar manner, but usually the user does not see play in the longitudinal direction as much of a problem.

Even though the embodiment shows separate sliders, the sliders may of course at the free end of the member be constructed in connection with a bushing, which may also function as top frame for closing the gap between the two members.

It is further understood that the invention naturally may be used for lifting columns having two or more members and for other purposes than just tables. Just to mention a few examples, the columns may be used in connection with adjustable beds or chairs. The columns may be constituted by aluminum or steel profiles or an intermixture of such profiles.

The invention is especially intended for electrically driven lifting columns where the drive unit may be an integral part of the column or be a separate unit, but is however not limited to this.

The invention claimed is:

1. A lifting column comprising:

at least two members arranged telescopically relative to each other, and at least one slider located between two successive members, said slider being secured to one of the two members, said one member including a wall with a groove therein that outlines a resilient section thereof against which at least a part of the slider rests.

2. The lifting column according to claim 1, wherein the members consist of tube profiles.

3. The lifting column according to claim 2, wherein at least at one end of said one member there are resilient sections equipped with sliders on at least two opposing sides of said one member.

4. The lifting column according to claim 2, wherein the tube profiles have a circular cross section.

5. The lifting column according to claim 4, wherein at least at one end of said one member there are four resilient sections equipped with sliders having a mutual distance of 90°.

6. The lifting column according to claim 1, wherein the groove includes two groove lengths running in a longitudinal direction of the member and located at a mutual distance.

7. The lifting column according to claim 6, wherein the groove lengths in the longitudinal direction of the member at one end are connected to a transverse groove length, such that the resilient section appears as a tongue.

8. The lifting column according to claim 7, wherein the resilient section is located at, but at a distance from, an end of said one member such that said one member from the resilient section to the adjacent end of said one member remains unbroken.

9. The lifting column according to claim 7, wherein a distance which the resilient section is located from the end of said one member is shorter than an axial extent of the resilient section.

10. The lifting column according to claim 6, including two successive resilient sections located as a pair in the axial direction of said one member at at least one end of said one member.

11. The lifting column according to claim 10, wherein the two resilient sections are arranged mirror-inverted relative to each other.

12. The lifting column according to claim 10, wherein there are only resilient sections at the end of said one member, which during the telescopic movement constantly is in contact with the other member.

13. The lifting column according to claim 1, wherein at least one slider as a brick-shaped element is designed as an elongated sliding device.

14. The lifting column according to claim 13, wherein the area of the sliding device outside the sliders is thinner than the sliders.

15. The lifting column according to claim 13, wherein the sliders at one free end are furnished with a stepping down at the rear side facing the member, such that it is thinner than the remaining slider engaging the resilient section and that the end further is beveled with a slanting surface.

16. The lifting column according to claim 15, wherein the rear side of the sliding device includes at least one cam extending into a recess in said one member intended for that purpose for securing the sliding device to said one member.

17. The lifting column according to claim 13, wherein a longitudinal rib for securing against rotation is designed on a front side of the sliding device, said rib being intended for protruding into a longitudinal groove on the inner side of a surrounding member in order to prevent said one member equipped with the sliding device and a surrounding member from rotating relative to each other.

18. The lifting column according to claim 13, wherein the sliding device has an elongated section connecting a brick-shaped slider at each end of the sliding device and that the elongated section is thinner than the sliders.

19. A table comprising a lifting column which comprises:

at least two members ranged telescopically relative to each other, and at least one slider located between two successive members, said slider being secured to one of the two members, said one member including a wall with a groove therein that outlines resilient section thereof against which at least a part of the slider rests.

* * * * *